US008376872B1

(12) United States Patent
Murphy

(10) Patent No.: US 8,376,872 B1
(45) Date of Patent: Feb. 19, 2013

(54) GOLF GLOVE

(76) Inventor: David P Murphy, Quincy, MA (US)

( * ) Notice: Subject to any disclaimer, the term of this patent is extended or adjusted under 35 U.S.C. 154(b) by 695 days.

(21) Appl. No.: 12/275,482

(22) Filed: Nov. 21, 2008

Related U.S. Application Data

(60) Provisional application No. 60/989,533, filed on Nov. 21, 2007, provisional application No. 61/022,856, filed on Jan. 23, 2008.

(51) Int. Cl.
*A63B 69/36* (2006.01)
*A41D 19/00* (2006.01)

(52) U.S. Cl. ..... 473/205; 473/131; 2/161.2

(58) Field of Classification Search ..... 473/131, 473/201, 205, 409; 2/16, 158, 159, 160, 2/161.1, 161.2, 161.6, 162, 170
See application file for complete search history.

(56) References Cited

U.S. PATENT DOCUMENTS

| | | | | | |
|---|---|---|---|---|---|
| 3,229,307 | A | | 1/1966 | Jamison | |
| 3,508,280 | A | | 4/1970 | Osborn | 2/159 |
| 3,930,271 | A | | 1/1976 | Kahng | 2/161 A |
| 4,665,565 | A | | 5/1987 | Odom | 2/161 |
| 4,850,053 | A | | 7/1989 | Tepley et al. | |
| 4,858,246 | A | * | 8/1989 | Wiggins | 473/205 |
| D308,436 | S | | 6/1990 | Weitzell | D2/619 |
| 5,033,120 | A | | 7/1991 | Myers | 2/161 A |
| 5,365,609 | A | * | 11/1994 | Herzog | 2/161.4 |
| 5,414,868 | A | * | 5/1995 | Crawford | 2/160 |
| 5,592,695 | A | * | 1/1997 | Roche | 2/161.2 |
| 6,014,775 | A | | 1/2000 | Missry | 2/161.2 |
| D420,202 | S | | 2/2000 | Redwood et al. | |
| 6,073,269 | A | * | 6/2000 | Diaco | 2/160 |
| D431,691 | S | | 10/2000 | Redwood et al. | |
| D433,785 | S | | 11/2000 | Redwood et al. | |
| 6,205,588 | B1 | | 3/2001 | Shin | 2/161.4 |
| 6,415,445 | B1 | | 7/2002 | Nishijima et al. | |
| 6,421,836 | B1 | | 7/2002 | Park | 2/161.4 |
| 6,725,465 | B2 | * | 4/2004 | Taylor | 2/161.1 |
| 6,973,674 | B2 | | 12/2005 | Jackson, Jr. | |
| D532,162 | S | | 11/2006 | Bonzagni et al. | D29/116.2 |
| D545,002 | S | | 6/2007 | Voravan | D29/123 |
| D554,807 | S | | 11/2007 | Okumura | |
| D570,056 | S | | 5/2008 | Metcalf | D29/123 |
| D584,004 | S | | 12/2008 | Murphy | |
| D594,603 | S | | 6/2009 | Murphy | |
| D596,806 | S | | 7/2009 | Murphy | |
| 2002/0116745 | A1 | | 8/2002 | Taylor | |

OTHER PUBLICATIONS

U.S. Appl. No. 29/317,254, filed Apr. 25, 2008, Murphy, David P.
U.S. Appl. No. 29/324,584, filed Sep. 16, 2008, Murphy, David P.
U.S. Appl. No. 60/989,533, filed Nov. 21, 2007, Murphy, David P.
U.S. Appl. No. 61/022,856, filed Jan. 23, 2008, Murphy, David P.

* cited by examiner

*Primary Examiner* — Nini Legesse
(74) *Attorney, Agent, or Firm* — Burns & Levinson LLP; Jacob N. Erlich; Marlo Schepper Grolnic

(57) ABSTRACT

A golf glove having a finger retaining component. The finger retaining component may be affixed to the glove of one hand at or near the index finger to receive and secure a finger or fingers from the other hand.

7 Claims, 10 Drawing Sheets

GOLF GLOVE

This application claims the priority date of Provisional Application Ser. No. 60/989,533, entitled GOLF GLOVE, filed on Nov. 21, 2007, and Provisional Application Ser. No. 61/022,856, entitled GOLF GLOVE, filed on Jan. 23, 2008, which this application incorporates by reference in their entirety.

BACKGROUND

The present teachings relate generally to gloves used for gripping and, more particularly, to golf gloves used to grip golf clubs. In the game of golf a firm and proper grip is critical for a successful swing and, as a consequence, to successfully make contact with a golf ball. What is needed are a golf glove and method of using that ensure a proper grip on the golf club handle to consistently achieve a successful swing.

SUMMARY

The needs set forth herein as well as further and other needs and advantages are addresses by the present embodiments, which illustrate solutions and advantages described below.

The glove of the present embodiment includes, but is not limited to, a finger retaining component adjacent to the index and middle fingers of a glove, such that when the user inserts a finger from a second hand, both hands are interlocked together by the finger retaining component. The method of the present embodiment includes the use of the glove for gripping a member.

Other embodiments of the system and method are described in detail below and are also part of the present teachings.

For a better understanding of the invention, together with other and further aspects thereof, reference is made to the accompanying drawings and detailed description, and its scope will be pointed out in the appended claims.

DETAILED DESCRIPTION

Figure 1:
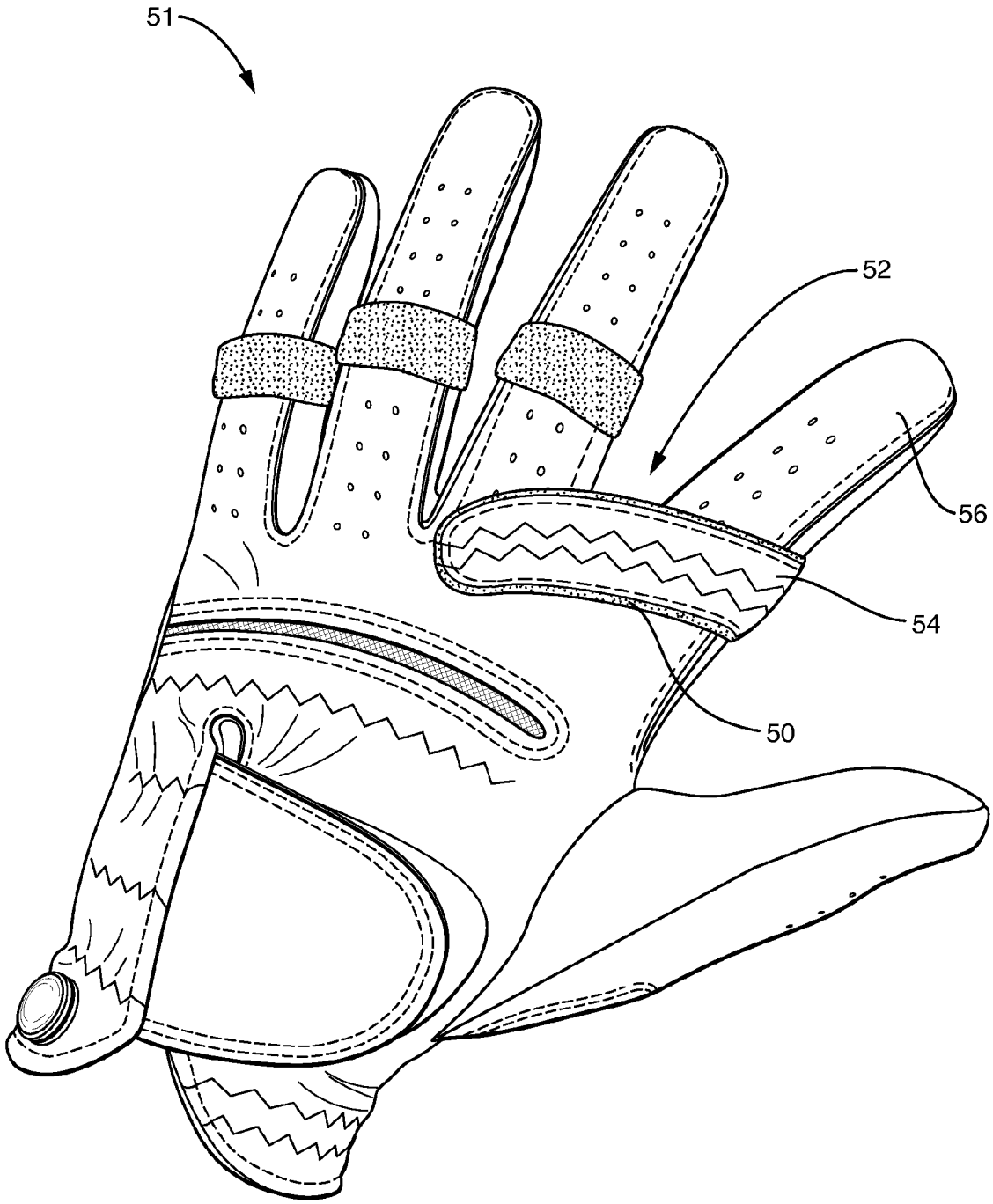
FIG. 1 is a pictorial of the top view of one embodiment of the golf glove.

The present teachings are described more fully hereinafter with reference to the accompanying drawings, in which the present embodiments are shown. The following description is presented for illustrative purposes only and the invention should not be limited to these embodiments.

Although golf gloves exist with gripping material in the palm area to help a golfer grip his or her club handle, that gripping material is only effective so long as the golfer maintains a tight grip. In addition, existing golf gloves do not promote a proper grip to help a golfer swing the club correctly and consistently.

To employ a standard golf grip the golfer holds the club handle in a first hand with the thumb facing down and overlaps the first hand with the second hand. The pinky of the second hand may overlap the index finger of the first hand to help create a tighter grip. Using this standard grip creates a trough for the club handle. When the hands are tightened they completely envelope the club handle and a solid connection is formed between the golfer and the club.

The overlapping hand has a tendency to slide apart from the other hand during the swing. The twisting motion of the golfer's arms and shoulders relative to the golfer's stance create pressures on the gripping hands, loosening the golfer's grip. The different positioning of the arms at the beginning of the backswing, the downswing where the club head makes contact with the ball, and the follow-through swing each affect the golfer's grip and, as a consequence, the club's position. Any shifting of the hands during the swing affects contact with the ball.

The position of the club is important because even minor variations can affect the ball's release. Misalignment between the clubface and the swing plane can cause slices and hook shots. These shots impart spin that is unpredictable and reduce the distance the ball can travel. Golfers want to consistently hit the ball squarely so that they can adjust their power and aim with predictable results.

Since the golf grip is so important to the swing, golfers are often forced to concentrate on their grip throughout the swing. This is a problem since the golfer should instead be concentrating on the swing and making contact with the ball. Any loss of concentration can affect the golfer's swing, contact with the ball, and placement of the shot.

The standard golf grip can help provide consistency to the golfer because the positioning of the hands and grip on the club are consistent throughout the swing. The various embodiments of the golf glove disclosed herein promote an efficient and consistent swing by providing a retaining component to secure a finger or fingers from the user's overlapping hand. The pinky of the overlapping hand may be secured in a retaining component, which serves to interlock both hands together around the club handle in a proper standard golf grip.

The design of the retaining component promotes proper hand placement by securing both hands in the form of a standard golf grip. Because the hands are secured to each other by their fingers, any pressure on the overlapping hand to slide away from the gloved hand caused by the rotation of the golfer's body during the swing only further tightens the grip around the club handle.

The golfer may not require the use of the finger retaining component for every swing. For example, when putting the golfer may use a grip different from the standard golf grip. In such an instance the retaining component may not be used and because of its low profile it will not affect the golfer's traditional use of the glove.

Reference is now made to the drawings provided herein, and initially to FIG. 1, which is a pictorial of the top view of one embodiment of the golf glove 51. The finger retaining component 54 may be secured around the index finger 56 of the glove 51 and secured to the top of the glove 51 by stitching 50 or some other means of fastening. The pinky of the overlapping hand (e.g., on the non-glove hand) may then slide into the finger pocket 52 created by the finger retaining component 54 and shown in greater detail below.

The interlocking of the two hands by the finger retaining component 54 yields a standard golf grip and creates a trough for the golf club handle. The finger retaining component 54 confines the overlapping hand so that it will not loosen during the swing. Locking the two hands together in this way creates a consistent grip each time the golfer swings and throughout the swing.

The finger retaining component 54 may be constructed from material which may or may not stretch and which may be either permanently or removably affixed to the glove 51. The finger retaining component 54 is made sufficiently loose to accept a finger or fingers therein, yet not so loose as to permit the finger or fingers to slide out of the retaining component.

Figure 2:
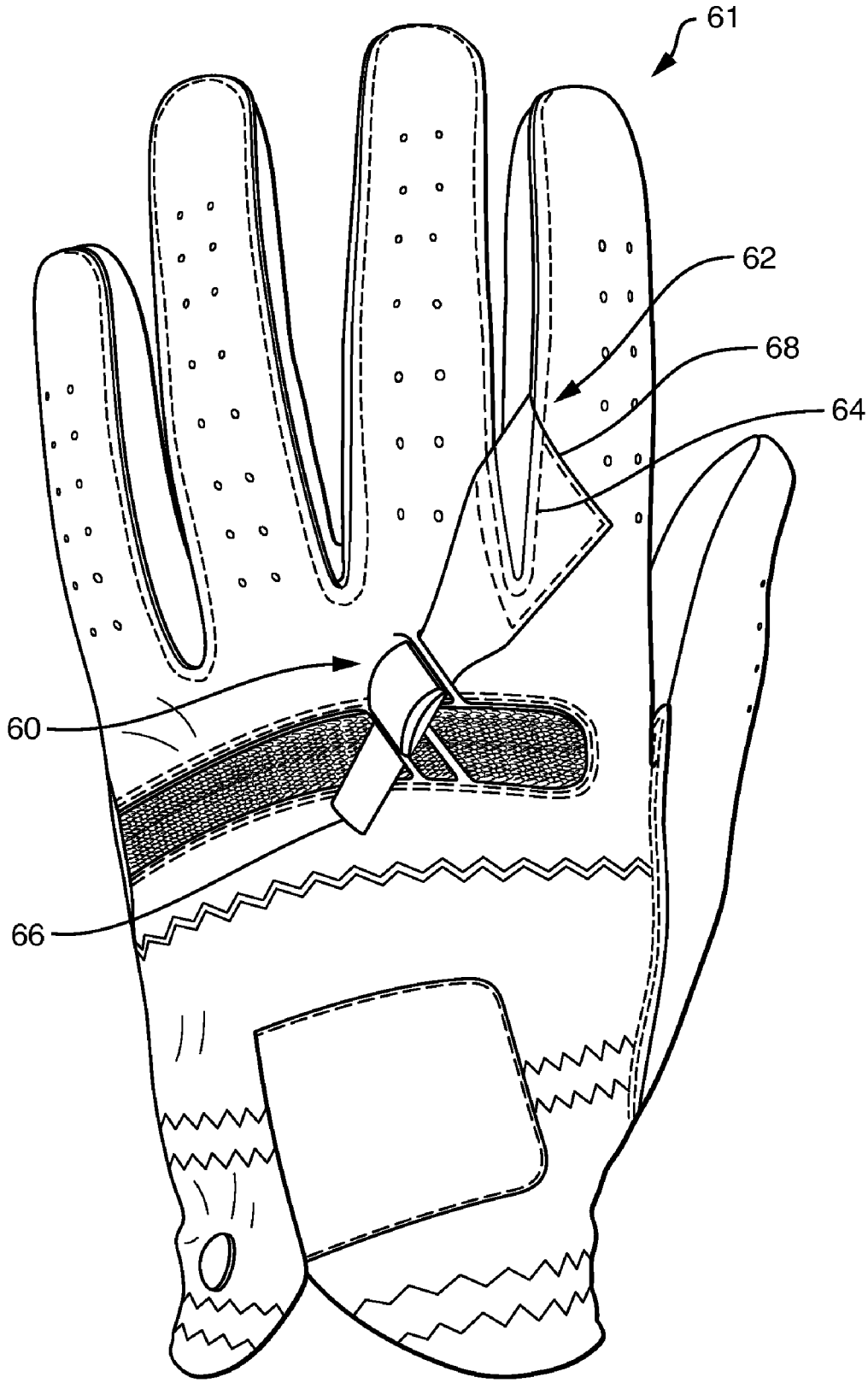
FIG. 2 is a pictorial of the top view of another embodiment of the golf glove.

Referring now to FIG. 2, shown is a pictorial of the top view of another embodiment of the golf glove 61. Here, the finger retaining component 64 is constructed with an adjustable strap and buckle 60. One end 68 of the retaining component strap may be permanently affixed to the glove 61 while the other may be loosened and tightened with the strap and buckle 60. The user may utilize the strap and buckle 60 by pulling on the end of the strap 66 to adjust the size of the finger pocket 62 created by the finger retaining component 64. The size of the finger pocket 62 can be adjusted to accommodate any size finger or fingers.

Figure 3:
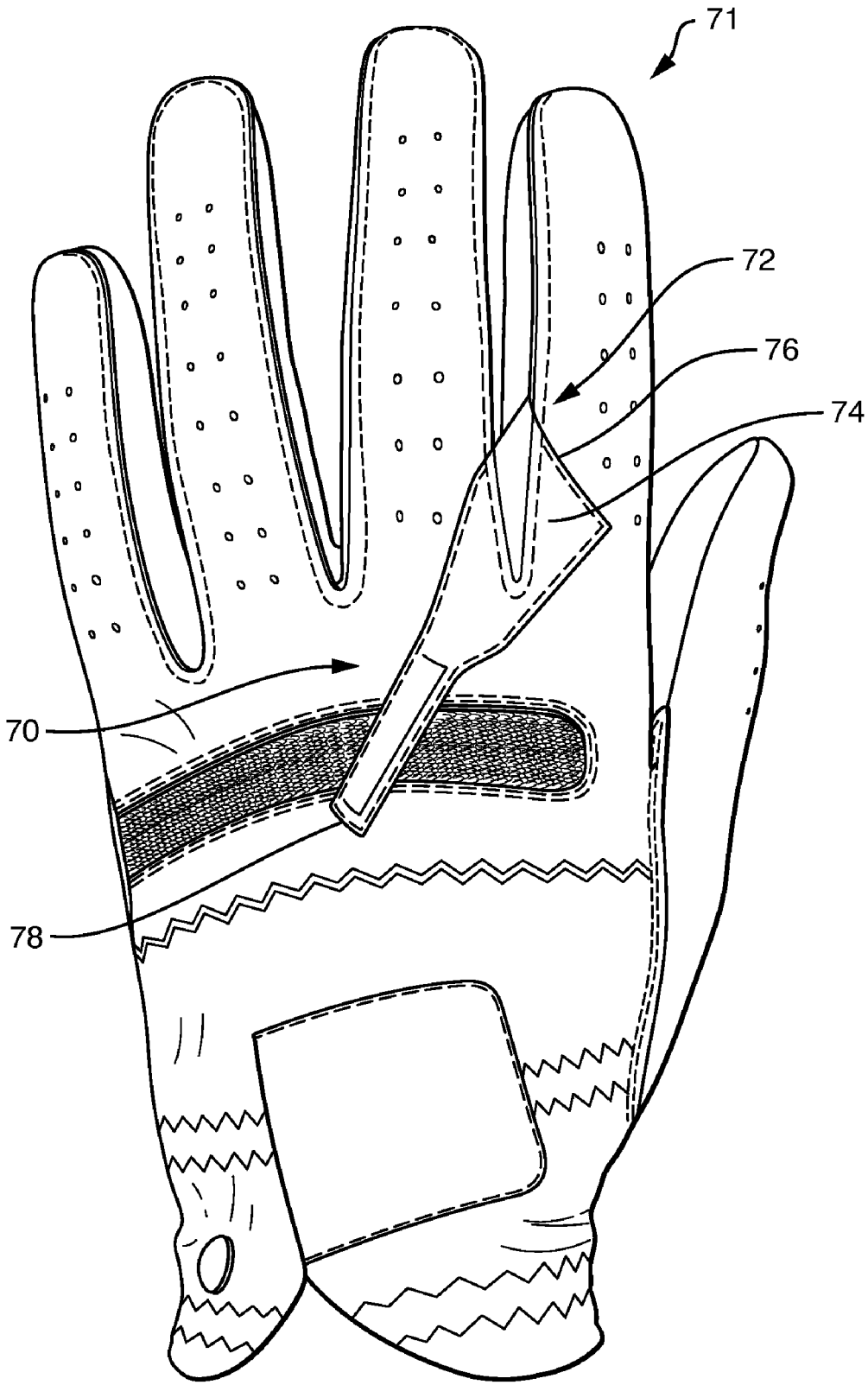
FIG. 3 is a pictorial of the top view of yet another embodiment of the golf glove.

Referring now to FIG. 3, shown is a pictorial of the top view of yet another embodiment of the golf glove 71. Here the golf glove 71 has been constructed with an adjustable finger retaining component 74 similar to that shown in FIG. 2, but this time using a loop and pile fastener 70. One end 76 of the retaining component strap may be permanently affixed to the glove 71 while the other end 78 may be removably fastened to the glove 71 with a loop and pile fastener 70. This permits the user to easily adjust the size of the finger pocket 72 created by the finger retaining component 74 to any number of sizes by engaging the corresponding parts of the loop and pile fastener 70.

Figure 4:
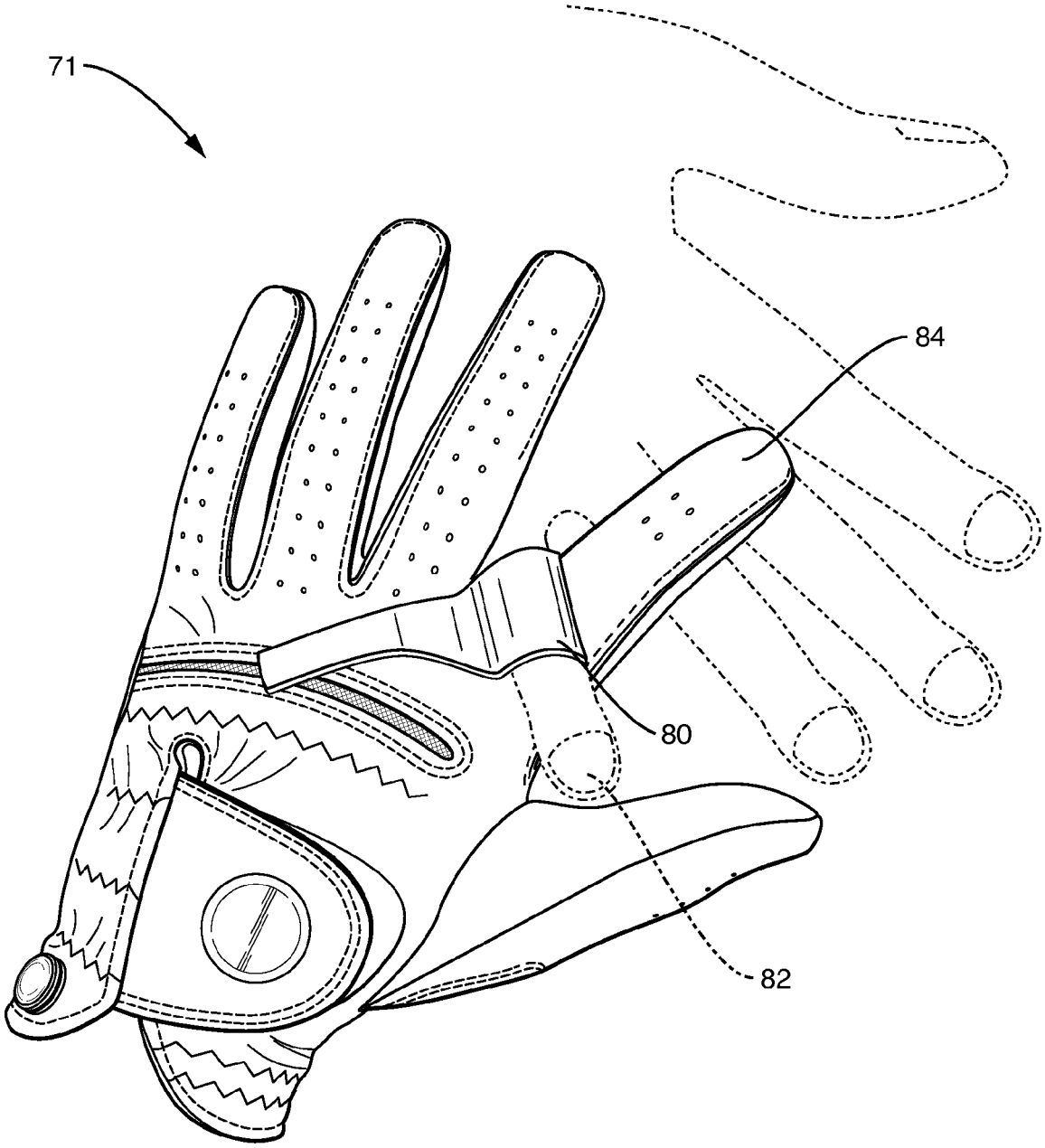
FIG. 4 is a pictorial of the top view of one embodiment of the golf glove on a hand employed with the pinky of the user's other hand secured in the finger retaining component.

Referring now to FIG. 4, shown is a pictorial of the top view of one embodiment of the golf glove 71 on a hand employed with the pinky 82 of the overlapping hand secured by the finger retaining component 80. The hands are shown spread to demonstrate how the finger retaining component 80 of the types described herein work. The finger retaining component 80 secures the pinky 82 of the overlapping hand to the gloved hand. The hands may then be folded downwards into each other to create a cavity for the club handle. The pinky 82 of the overlapping hand may wrap around the index finger 84 of the gloved hand to strengthen the grip. Once the hands are wrapped around the club handle they can be tightened, completely enveloping the club handle and creating a solid connection between the golfer and the club. A further description of the relationship between the pinky 82 and the finger retaining component 80 is provided below.

Figure 5:
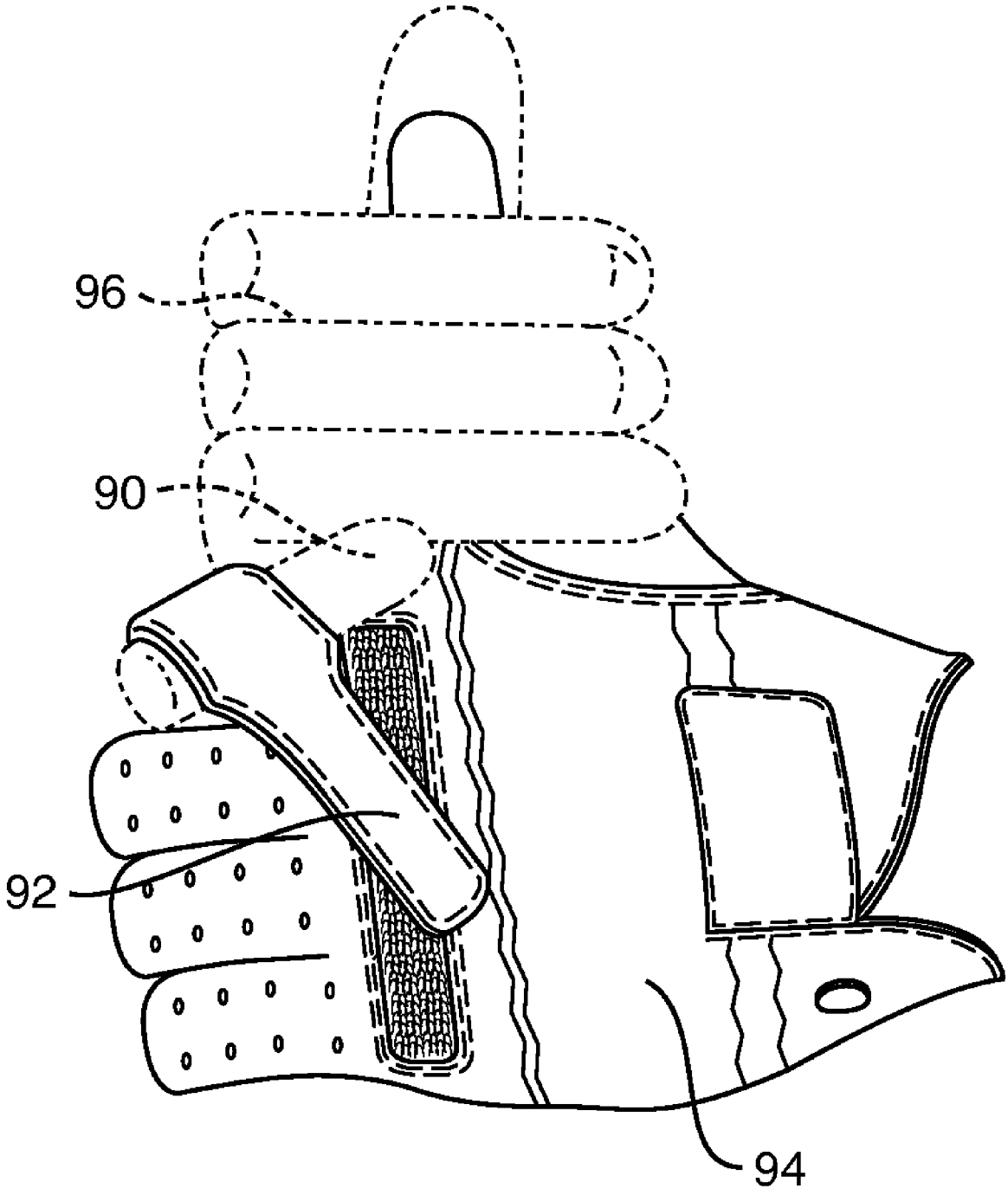
FIG. 5 is a pictorial of the front view of one embodiment of the golf glove employed in a standard golf grip.

Referring now to FIG. 5, shown is a pictorial of the front view of one embodiment of the golf glove (shown worn on golfer's left hand 94) employed in a standard golf grip. Following from FIG. 4, once the hands are folded down into each other they make the standard golf grip shown here. The right-handed golfer wears the golf glove on the left hand 94 and the golfer's right hand 96 overlaps the gloved left hand 94. The finger retaining component 92 on the gloved left hand 94 provides restraint for the pinky 90 of the ungloved right hand 96. The two hands are interlocked together to promote a firm and proper standard golf grip.

Similarly, the glove may be constructed for left-handed golfers. In this case, the glove may be worn on the right hand and the ungloved left hand may overlap the glove and engage the finger retaining component.

Figure 6:
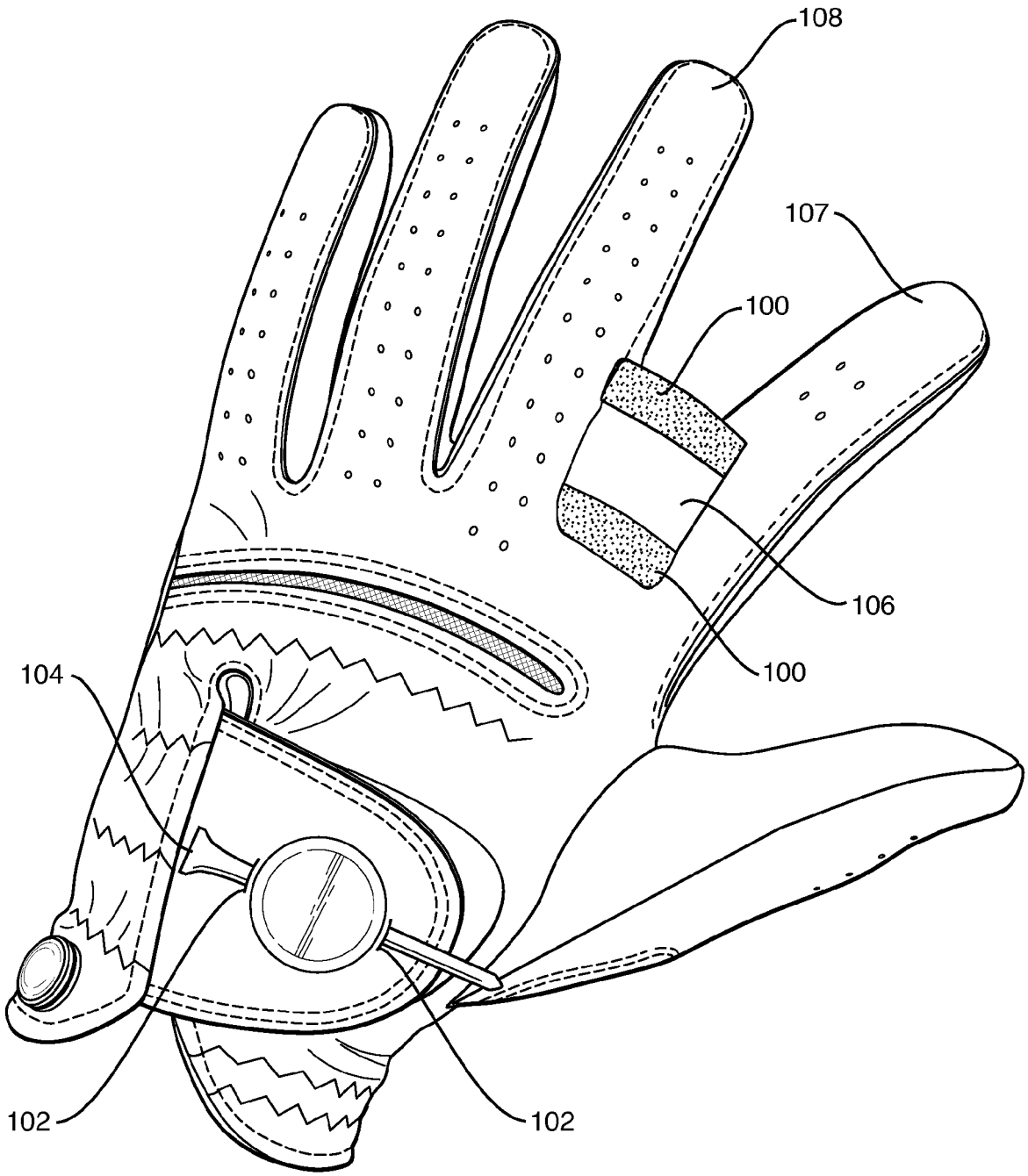
FIG. 6 is a pictorial of the top view of another embodiment of the golf glove with a receptacle for a golf tee.

Referring now to FIG. 6, shown is a pictorial of the top view of another embodiment of the golf glove with a receptacle for a golf tee 104. The finger retaining component 106 may be constructed by affixing suitable material to the inner sides of the index 107 and middle 108 fingers. This embodiment gives the finger retaining component a lower profile so that the glove may still be worn even when the standard golf grip is not employed such as, although not limited thereto, when a user is putting. The finger retaining component may be constructed from a non-elastic material and may have elastic on either or both of its edges to help secure a finger. In this way the finger retaining component 106 can accommodate fingers of various sizes without adjustment by the user. When not in use, the elastic material 100 may contract the finger retaining component to keep it out of the way.

The golf glove may also have a receptacle adapted for accepting a golf tee 104. In this way, a golf tee 104 can be stored out of the way yet be available for immediate use by the golfer. The receptacle may be fashioned by creating openings 102 in the glove for the golf tee to pass through. It is appreciated that there are a number of different ways to secure golf tees or other objects to the golf glove. For instance, a trough or troughs could be fashioned out of a solid material and affixed to the golf glove and the golf tees or other objects could be wedged into the trough or troughs and held in place.

Figure 7:
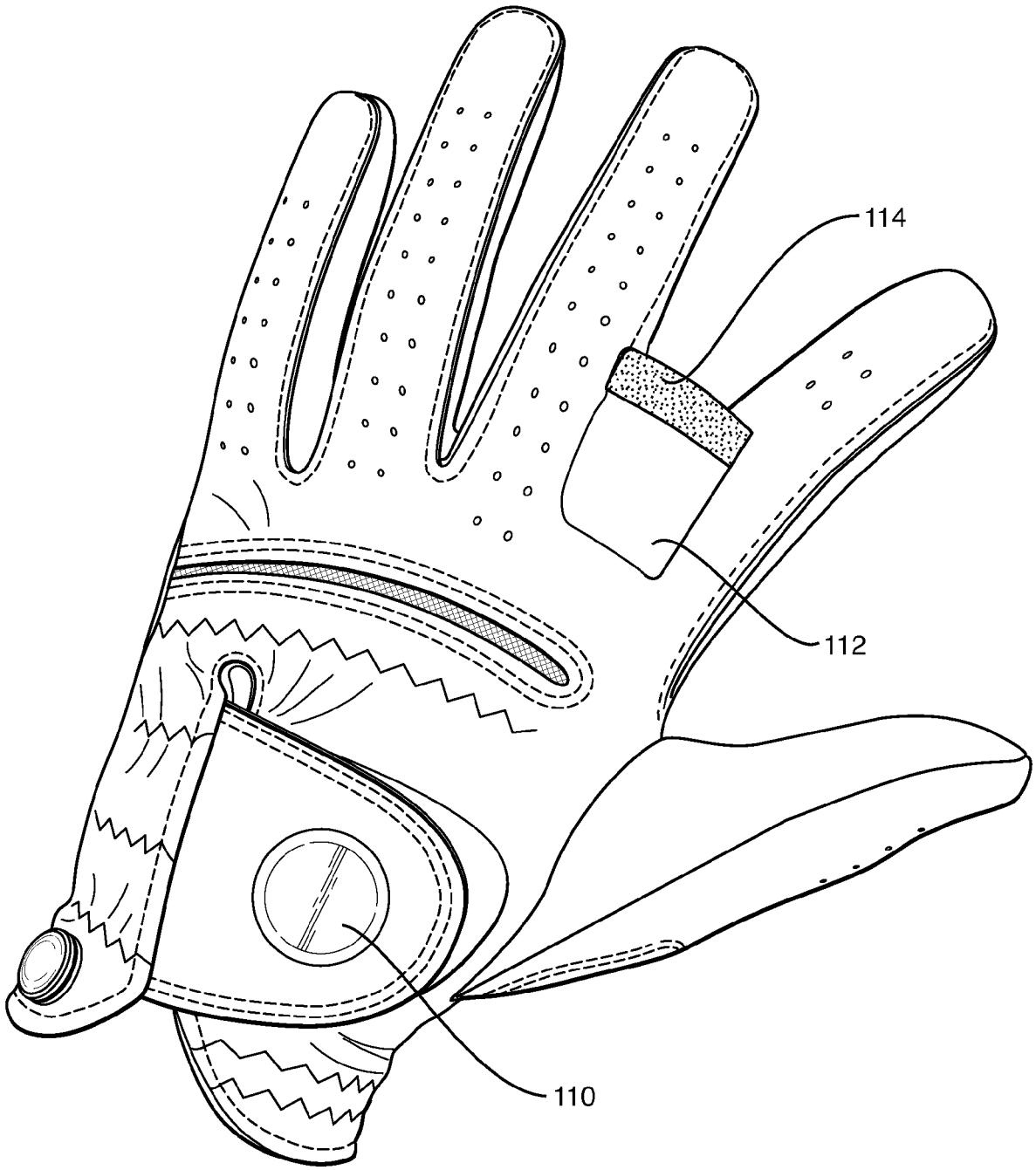
FIG. 7 is a pictorial of the top view of yet another embodiment of the golf glove with a detachable ball marker.

Referring now to FIG. 7, shown is a pictorial of the top view of yet another embodiment of the golf glove with a detachable ball marker 110. Here the golf glove has a slightly larger finger retaining component 112 than in FIG. 6 to accommodate a large finger or fingers. The ends of the finger retaining component 112 could be secured at a variety of places on the glove. For example, although not limited thereto, the finger retaining component 112 could extend from the pinky finger area all the way to the index finger area in order to provide a finger retaining component 112 sufficient for securing multiple fingers. The finger retaining component may have fringe material 114 on either or both edges. Such fringe material may provide for stiffness, increase the durability of the finger retaining component, provide for additional grip of the secured finger or fingers, or perform some other function.

The golf glove may also have a detachable ball marker 110. A ball marker allows a player to mark his or her ball on a green before picking up the ball to clean it or permit another player to make an unobstructed shot. The detachable ball marker 110 may be a small disk and may be secured to the glove by magnetism, loop and pile fastening, snap fastening, or some other fastening means. The ball marker may have a logo, may be colored, or may have some other design feature, and may be in any number of shapes and sizes.

Figure 8:
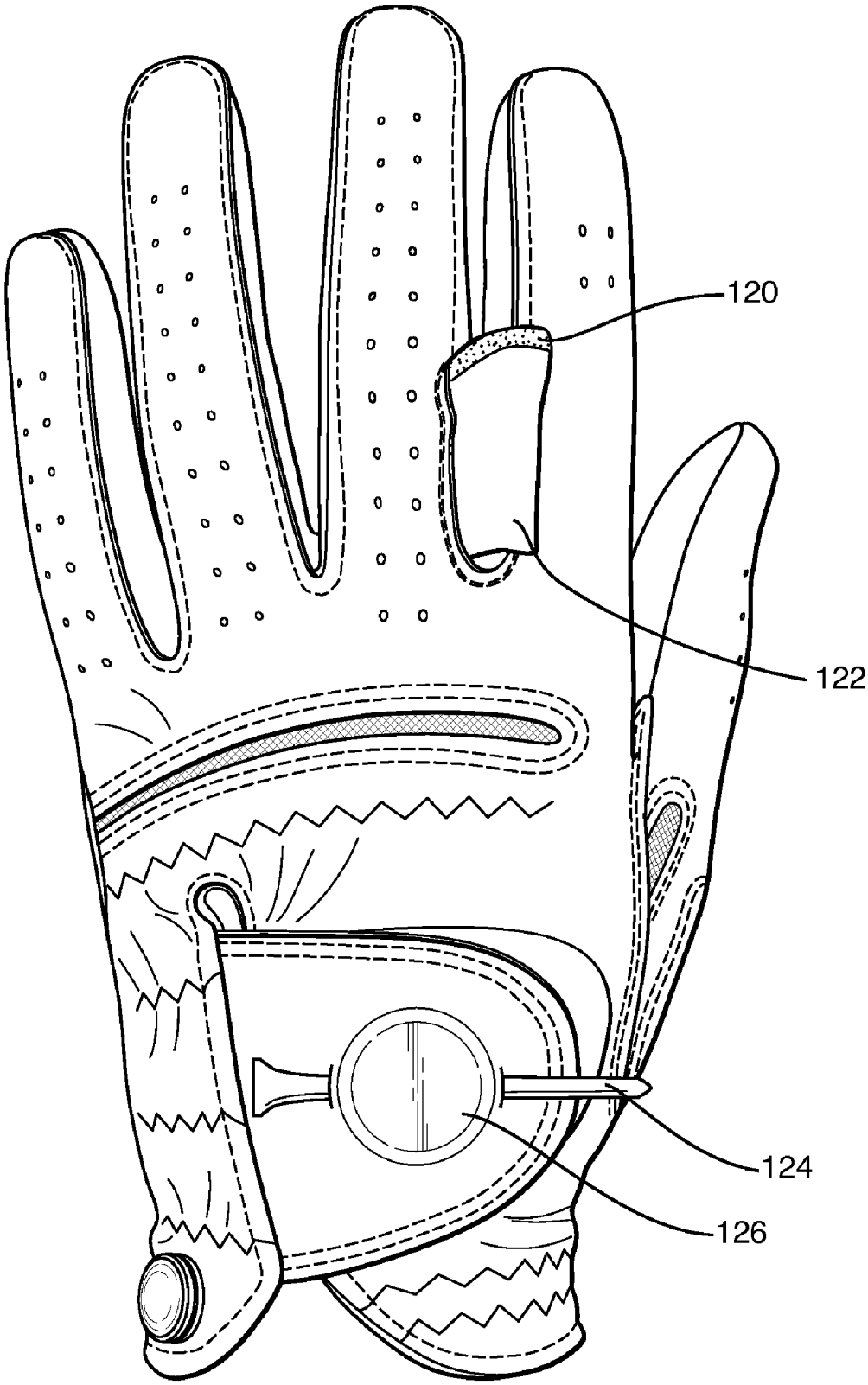
FIG. 8 is a pictorial of the top view of still another embodiment of the golf glove.

Referring now to FIG. 8, shown is a pictorial of the top view of still another embodiment of the golf glove. As shown in FIGS. 6 and 7, the golf glove may have both a receptacle for holding a golf tee 124 as well as a detachable ball marker 126. The golf glove may be colored and may have ornamental designs. The finger retaining component 122 may have a similar color or design to match the rest of the glove and a fringe material 120 to help secure a finger or fingers.

Figure 9:
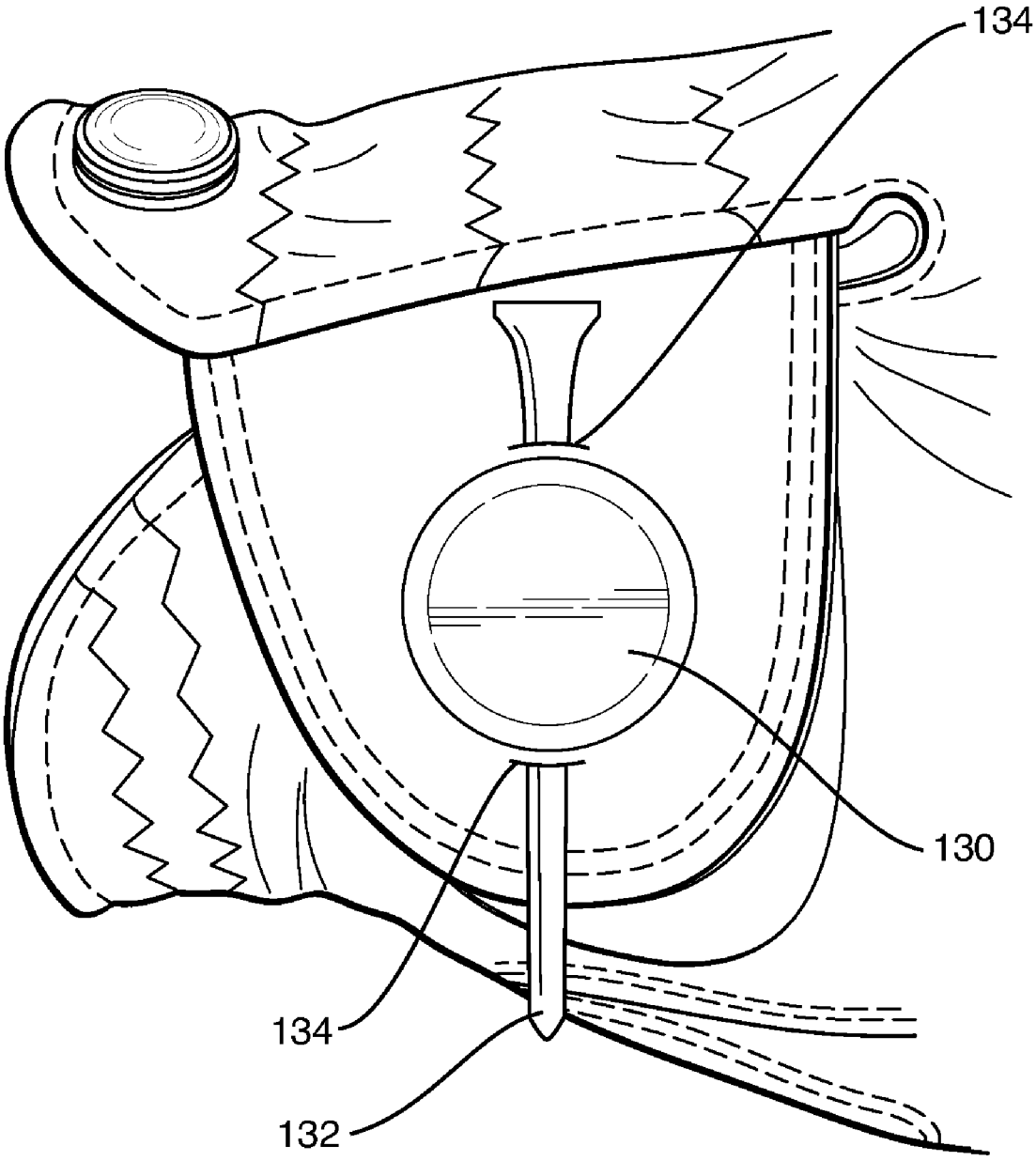
FIG. 9 is a pictorial of an enlarged view of one embodiment of the golf tee receptacle.

Referring now to FIG. 9, shown is a pictorial of an enlarged view of one embodiment of the golf tee receptacle. The receptacle may be fashioned by creating openings 134 in the glove sufficient for holding a golf tee 132. The golf tee 132 may be stored under a detachable ball marker 130. It is appreciated that the receptacle could be fashioned in any number of different ways and hold multiple golf tees or any number of other objects.

Figure 10:
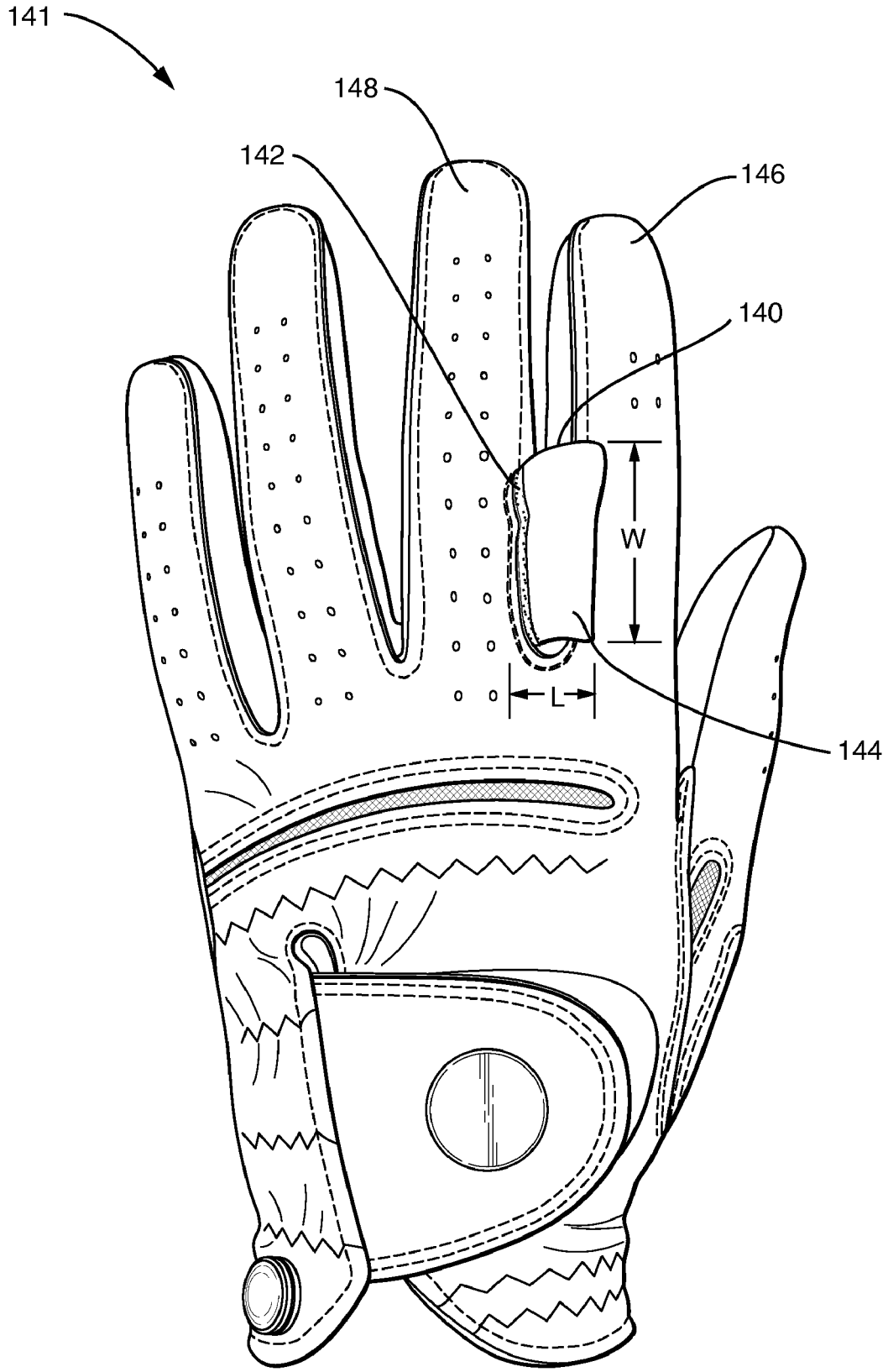
FIG. 10 is a pictorial of the top view of another embodiment of the golf glove.

Referring now to FIG. 10, shown is a pictorial of the top view of another embodiment of the golf glove 141. The finger retaining component 144 may have a small profile so that it does not affect use of the glove 141 without employing the finger retaining component 144. This may be accomplished by connecting a small amount of suitable material to the insides of the index and middle fingers to construct the finger retaining component 144. Elastic 142 or some other resilient material may be used on one or both ends of the finger retaining component 144 to create an adjustable finger pocket 140 for restraining a finger or fingers.

The ends of length L of the finger retaining component 144 may be secured inside of the index 146 and middle 148 fingers. In this way, the finger retaining component 144 does not overlap either of the fingers, so normal movement of the index 146 and middle 148 fingers is not constricted. In one embodiment, the length L need only be approximately 3.5 cm, although not limited thereto. In fact, the length L of the finger retaining component 144 could be approximately 5 cm long or longer, although it should be sized such that it properly restricts the finger of the overlapping hand. The elastic 142 or other resilient material stretches to accommodate and constricts to restrain a finger of the overlapping hand.

The finger retaining component 144 may be affixed to the index 146 and middle 148 fingers above where they connect. This permits the pinky (or other finger) of the overlapping hand to engage the finger retaining component 144 by inserting between it and the part of the glove where the index 146 and middle 148 fingers join together or meet, and the finger retaining component 144 covers only approximately a portion of the restrained finger, such as, between knuckles. In one embodiment, the width W of the finger retaining component 144 may only be approximately 2 cm, although not limited thereto. The width W may be approximately 4 cm or wider, although it should be sized so that it permits adequate movement of the finger of the overlapping hand. The small width W of the finger retaining component 144 means that knuckles of the finger of the overlapping hand (engaged in the finger retaining component 144) are not constricted. In this way, the finger of the overlapping hand is free to, for example, wrap around the index finger 146 for additional grip.

Although the invention has been shown as a golf glove, many other applications exist for the invention, both sport-related, such as swinging a baseball bat, and otherwise, such as swinging an axe. It is appreciated that gloves that create a firm grip are needed in many activities and this invention is not limited to the sport of golf.

While the present invention has been described above in terms of specific embodiments, it is to be understood that the invention is not limited to these disclosed embodiments. Many modifications and other embodiments of the invention will come to mind to those skilled in the art to which this invention pertains, and which are intended to be and are covered by both this disclosure and the appended claims. It is intended that the scope of the invention should be determined by proper interpretation and construction of the appended claims and their legal equivalents, as understood by those of skill in the art relying upon the disclosure in this specification and the attached drawings.

What is claimed is:

1. A glove comprising:

an index finger sheath having an open end, a closed end, a first side, a second side, a top side, and a bottom side;

a middle finger sheath having an open end, a closed end, a first side, a second side, a top side, and a bottom side;

a thumb sheath having an open end, a closed end, a first side, a second side, a top side, and a bottom side;

a hand sheath having a finger end, a cuff end, a top side, and a bottom side;

said open end of the index finger sheath, said open end of the middle finger sheath, and said open end of the thumb sheath are adjacent to said finger end of the hand sheath;

said top side of the index finger sheath, said top side of the middle finger sheath, and said top side of the thumb sheath are adjacent to said top side of the hand sheath;

said second side of the thumb sheath is adjacent to said first side of the index finger sheath;

said second side of the index finger sheath is adjacent to said first side of the middle finger sheath; the middle finger sheath also having a second side;

said index finger sheath, said middle finger sheath, and said thumb sheath are each capable of independent movement relative to each other;

a finger retaining component having a first end affixed to an inner seam of said second side of said index finger sheath and a second end affixed to an inner seam of said first side of said middle finger sheath, said finger retaining component partially constructed from a non-elastic material and partially constructed from material capable of stretching, said material capable of stretching being located at either of said first and second ends or at both of said first and second ends of said finger retaining component in order to permit said finger retaining component to be contracted between said index finger sheath and said middle finger sheath to enable a user to use the glove, whether in the standard golf grip or not;

said finger retaining component having a length of approximately 3.5 cm to limit coverage to not more than one joint of a finger; and wherein a pinky finger of a hand at least partially overlapping the glove engages said finger retaining component by insertion into said finger retaining component such that, when the pinky finger of the overlapping hand is inserted into said finger retaining component, not more than one joint of the pinky finger of the overlapping hand is covered by said finger retaining component.

2. The glove of claim 1 further comprising a removable ball marker on the top of said hand sheath.

3. The glove of claim 2 further comprising a receptacle for at least one golf tee under said removable ball marker.

4. The method of claim 1 further comprising contracting said finger retaining component between said index finger sheath and said middle finger sheath when the standard golf grip is or is not used.

5. A method of using a golf glove comprising:

putting on a first hand having a top and a bottom a glove having an index finger sheath having an open end, a closed end, a first side, a second side, a top side, and a bottom side;

a middle finger sheath having an open end, a closed end, a first side, a second side, a top side, and a bottom side;

a thumb sheath having an open end, a closed end, a first side, a second side, a top side, and a bottom side;

a hand sheath having a finger end, a cuff end, a top side, and a bottom side;

said open end of the index finger sheath, said open end of the middle finger sheath, and said open end of the thumb sheath are adjacent to said finger end of the hand sheath;

said top side of the index finger sheath, said top side of the middle finger sheath, and said top side of the thumb sheath are adjacent to said top side of the hand sheath;

said second side of the thumb sheath is adjacent to said first side of the index finger sheath;

said second side of the index finger sheath is adjacent to said first side of the middle finger sheath; the middle finger sheath also having a second side;

said index finger sheath, said middle finger sheath, and said thumb sheath are each capable of independent movement relative to each other;

a finger retaining component having a first end affixed to an inner seam of said second side of said index finger sheath and a second end affixed to an inner seam of said first side of said middle finger sheath, said finger retaining component partially constructed from a non-elastic material and partially constructed from material capable of stretching, said material capable of stretching being located at either of said first and second ends or at both of said first and second ends of said finger retaining component in order to permit said finger retaining component to be contracted between said index finger sheath and said middle finger sheath to enable a user to use the glove, whether in the standard golf grip or not;

said finger retaining component having a length of approximately 3.5 cm to limit coverage to not more than one joint of a finger;

inserting a pinky finger from a second hand into said finger retaining component so that the pinky finger from the second hand at least partially overlaps said top of the first hand, and further so that, when the finger of the second hand is inserted into said finger retaining component, not more than one joint of the pinky finger of the second hand is covered by said finger retaining component;

gripping a member with said first hand and said second hand, the hands being interlocked by said finger retaining component.

6. The method of claim 5 wherein said member is a golf club.

7. The method of claim 5 further comprising creating a standard golf grip with said first hand and said second hand.

* * * * *

UNITED STATES PATENT AND TRADEMARK OFFICE

CERTIFICATE OF CORRECTION

PATENT NO. : 8,376,872 B1
APPLICATION NO. : 12/275482
DATED : February 19, 2013
INVENTOR(S) : David P. Murphy It is certified that error appears in the above-identified patent and that said Letters Patent is hereby corrected as shown below:

Title Page, Item (54) and in the Specification, column 1, line 1, the title of the application, "GOLF GLOVE" should read -- GOLF GLOVE AND METHOD OF USING --

Signed and Sealed this
Twenty-fifth Day of February, 2014

Michelle K. Lee

Michelle K. Lee
*Deputy Director of the United States Patent and Trademark Office*